US012352518B2

(12) United States Patent
Beitelspacher et al.

(10) Patent No.: US 12,352,518 B2
(45) Date of Patent: Jul. 8, 2025

(54) GAS OPERATING SYSTEM FOR LOW ENERGY AMMUNITION

(71) Applicant: KRL Holding Company, Inc, Eldridge, IA (US)

(72) Inventors: Joseph Beitelspacher, Grand Mound, IA (US); Konstantin Konev, Eldridge, IA (US); Michael Anthony Conger, Davenport, IA (US)

(73) Assignee: KRL Holding Company, Inc., Eldridge, IA (US)

( * ) Notice: Subject to any disclaimer, the term of this patent is extended or adjusted under 35 U.S.C. 154(b) by 0 days.

(21) Appl. No.: 18/415,988

(22) Filed: Jan. 18, 2024

(65) Prior Publication Data

US 2024/0240888 A1 Jul. 18, 2024

Related U.S. Application Data

(60) Provisional application No. 63/480,475, filed on Jan. 18, 2023.

(51) Int. Cl.
*F41A 5/26* (2006.01)
*F41A 5/24* (2006.01)

(52) U.S. Cl.
CPC ..... *F41A 5/24* (2013.01)

(58) Field of Classification Search
CPC .... F41A 5/24; F41A 5/26; F41A 21/28; F41A 5/18; F41A 3/66; F41A 5/28; F41A 15/12; F41A 17/38; F41A 17/56; F41A 17/58; F41A 19/16
USPC ..... 89/191.01, 193, 185; 42/16, 25, 18, 7, 42/70.04, 71.01, 75.01
See application file for complete search history.

(56) References Cited

U.S. PATENT DOCUMENTS

| | | | |
|---|---|---|---|
| 954,441 | A | 4/1910 | Krag |
| 2,035,539 | A | 3/1936 | Dicke |
| 2,865,256 | A | 12/1958 | Marsh |
| 2,887,013 | A | 5/1959 | Marsh |
| 3,359,860 | A | 12/1967 | Muhlemann |

(Continued)

FOREIGN PATENT DOCUMENTS

| | | | |
|---|---|---|---|
| CH | 251151 | A | 10/1947 |
| DE | 955393 | C | 1/1957 |

(Continued)

OTHER PUBLICATIONS http://www.kalashnikov.ru/upload/medialibrary/44a/020_026.pdf.

(Continued)

*Primary Examiner* — Michael D David
(74) *Attorney, Agent, or Firm* — Woodard, Emhardt, Henry, Reeves & Wagner, LLP

(57) ABSTRACT

A gas operating system for a firearm for use with low energy ammunition that includes a barrel having a maximum pressure experienced at a maximum pressure location when firing the low energy ammunition where a gas port is positioned distally from the maximum pressure location in a region of the barrel that experiences between 90% of the maximum pressure and 40% of the maximum pressure, a gas block on the barrel and a tube connecting the gas block to a bolt carrier, where the gas block directs energy from combustion gas pressure vented through the gas port to the bolt carrier via the tube.

20 Claims, 16 Drawing Sheets

(56) References Cited

U.S. PATENT DOCUMENTS

| | | | | |
|---|---|---|---|---|
| 4,611,525 | A | 9/1986 | Bosshard | |
| 4,619,184 | A | 10/1986 | Shalev | |
| 5,351,598 | A | 10/1994 | Schuetz | |
| 8,746,126 | B2 | 6/2014 | Zheng | |
| 9,500,422 | B2 | 11/2016 | Gomirato | |
| 9,719,742 | B2 | 8/2017 | Zeman | |
| 9,766,026 | B2 | 9/2017 | Hirt | |
| 10,151,544 | B1 * | 12/2018 | Sugg | F41A 5/26 |
| 10,746,493 | B1 * | 8/2020 | Steimke | F41A 9/29 |
| 11,199,370 | B1 * | 12/2021 | Sugg | F41A 5/26 |
| 11,994,355 | B1 * | 5/2024 | Sugg | F41A 5/26 |
| 2011/0271827 | A1 | 11/2011 | Larson | |
| 2014/0076151 | A1 * | 3/2014 | Kramer | F41A 5/26 89/193 |
| 2015/0267978 | A1 * | 9/2015 | Miller | F41A 3/26 89/198 |
| 2015/0267979 | A1 * | 9/2015 | Miller | F41A 19/13 89/191.01 |
| 2016/0161200 | A1 * | 6/2016 | Windauer | F41A 5/28 89/193 |
| 2016/0363406 | A1 * | 12/2016 | Wiesblott | F41A 21/28 |
| 2017/0198997 | A1 * | 7/2017 | Geissele | F41A 3/66 |
| 2019/0310037 | A1 * | 10/2019 | Barton | F41A 9/38 |
| 2019/0331450 | A1 * | 10/2019 | Steimke | F41A 3/26 |
| 2020/0025477 | A1 * | 1/2020 | Williams | F41A 3/66 |
| 2020/0182580 | A1 * | 6/2020 | Williams | F41A 27/30 |
| 2024/0344798 | A1 * | 10/2024 | Reints | F41A 21/30 |

FOREIGN PATENT DOCUMENTS

| | | | |
|---|---|---|---|
| DE | 963399 | C | 5/1957 |
| DE | 1008154 | B | 5/1957 |
| DE | 1039413 | B | 9/1958 |

OTHER PUBLICATIONS https://dockeryarmory.com/type-79/.
https://en.wikipedia.org/wiki/Type_79_submachine_gun.
Machine Translation of CH251151A by PatDocs PDF Export on Dec. 11, 2024 (pp. 3).
Machine Translation of DE1008154B by PatDocs PDF Export on Dec. 11, 2024 (pp. 4).
Machine Translation of DE1039413B by PatDocs PDF Export on Dec. 11, 2024 (pp. 4).
Machine Translation of DE955393C by PatDocs PDF Export on Dec. 11, 2024 (pp. 5).
Machine Translation of DE963399C by PatDocs PDF Export on Dec. 11, 2024 (pp. 4).

* cited by examiner

GAS OPERATING SYSTEM FOR LOW ENERGY AMMUNITION

CROSS-REFERENCE TO RELATED APPLICATIONS

This application claims the benefit of U.S. Provisional Application No. 63/480,475, filed Jan. 18, 2023, which is hereby incorporated by reference.

BACKGROUND

This disclosure relates to the field of gas operating systems for firearms using low energy ammunition such as pistol caliber ammunition.

Automatic and semi-automatic weapons have employed a variety of gas-operated systems utilizing the pressure of combustion gases released upon firing of a round to engage and displace a bolt mechanism to unlock, extract, eject, feed, reload, lock and cock before firing the next round. Many of the prior art systems employ a piston-cylinder arrangement mounted parallel with the gun barrel. Other prior art systems employ direct impingement of combustion gasses against the bolt mechanism. Either way, a gas operating system used with low energy ammunition, such as pistol caliber ammunition, can have more failures to adequately cycle compared to similar systems that use high energy ammunition, such as rifle caliber ammunition, due to comparatively lower combustion gas pressure and potentially greater variability in combustion gas pressure between different loads of the same caliber ammunition.

There is also a desire to convert firearm platforms originally designed for rifle caliber ammunition to use pistol caliber ammunition. Pistol caliber ammunition is generally less expensive than rifle caliber ammunition. In addition, pistol caliber ammunition can be lighter than rifle caliber ammunition. Furthermore, if a firearm uses a suppressor and subsonic ammunition, pistol caliber ammunition can be configured for this application due to generally lower bullet velocities and generally larger diameter rounds.

There is a need for gas operating systems operable with low energy ammunition.

DETAILED DESCRIPTION OF THE DRAWINGS

Figure 1:
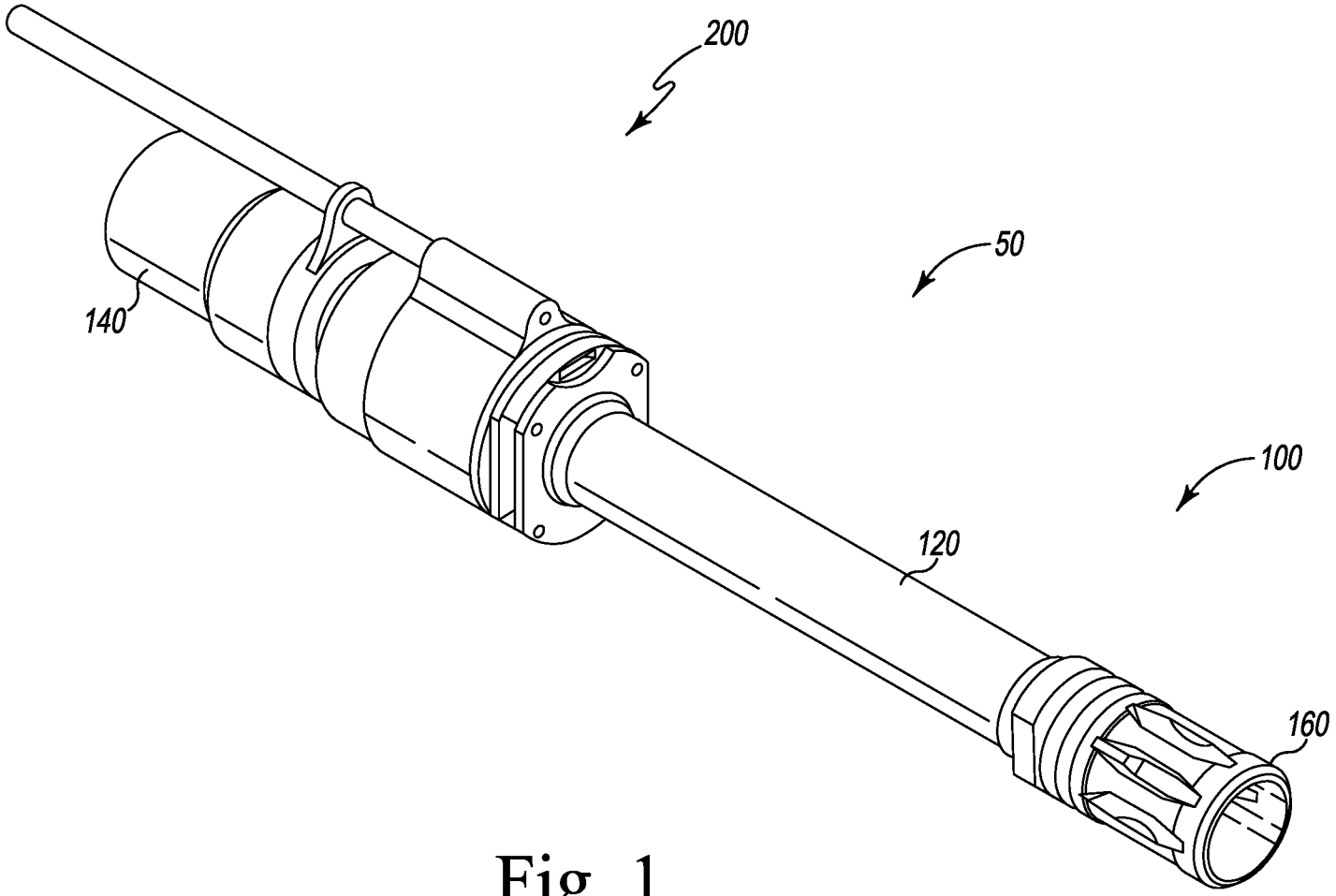
FIG. 1 is a perspective view of a barrel assembly.
Figure 2:
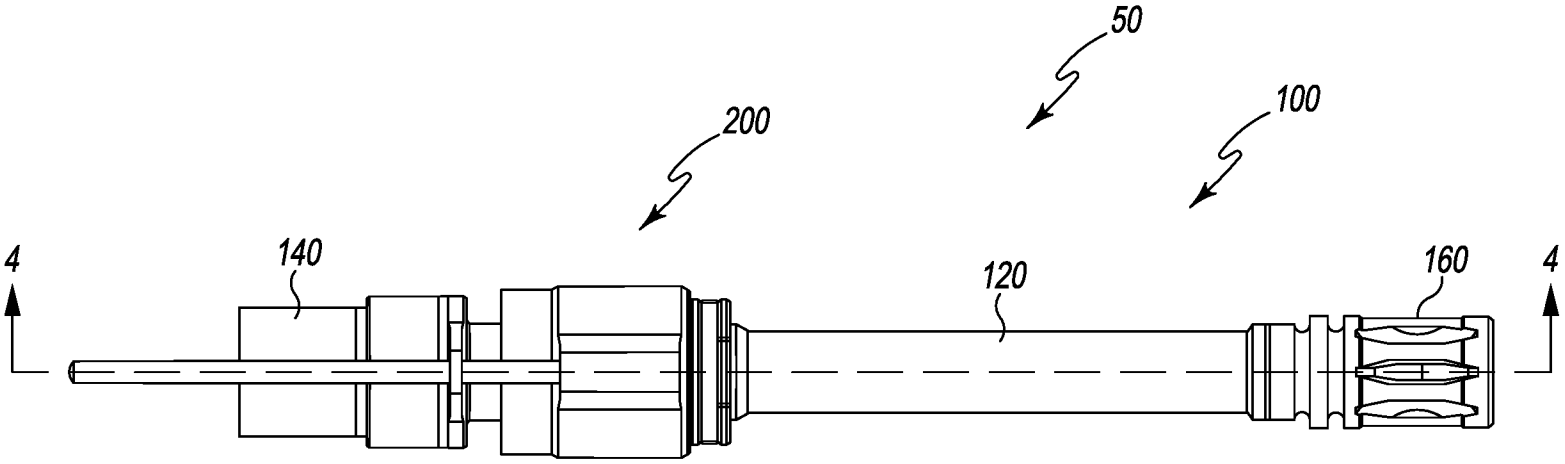
FIG. 2 is a top view of the FIG. 1 barrel assembly.
Figure 3:
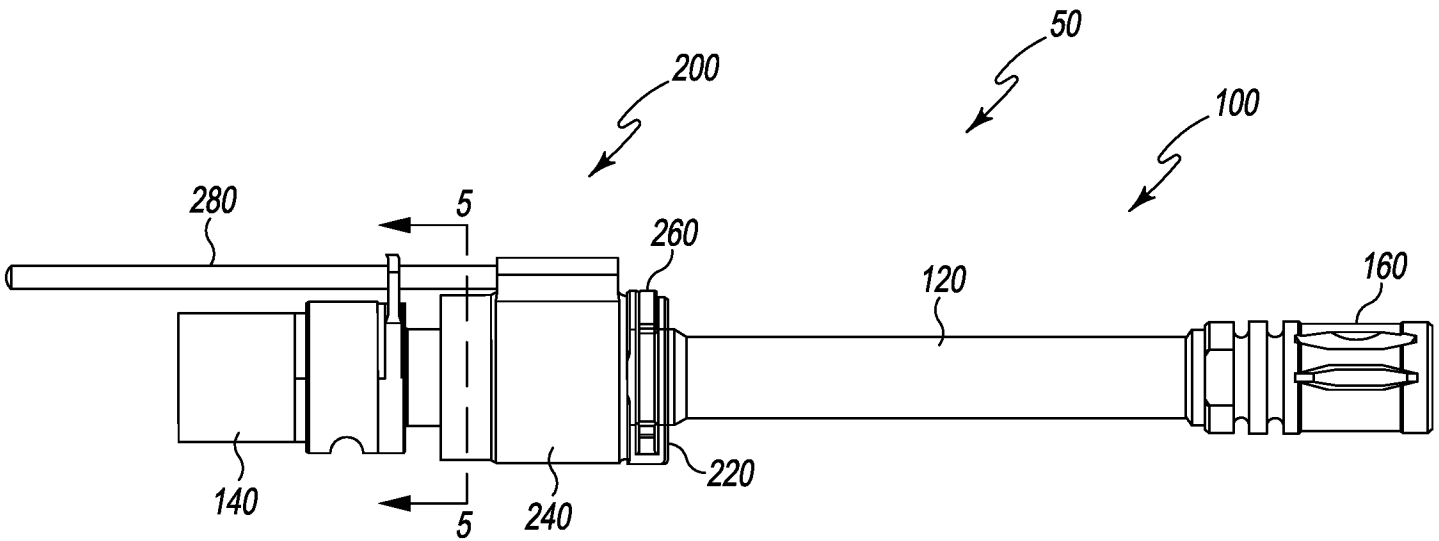
FIG. 3 is a side view of the FIG. 1 barrel assembly.
Figure 4:
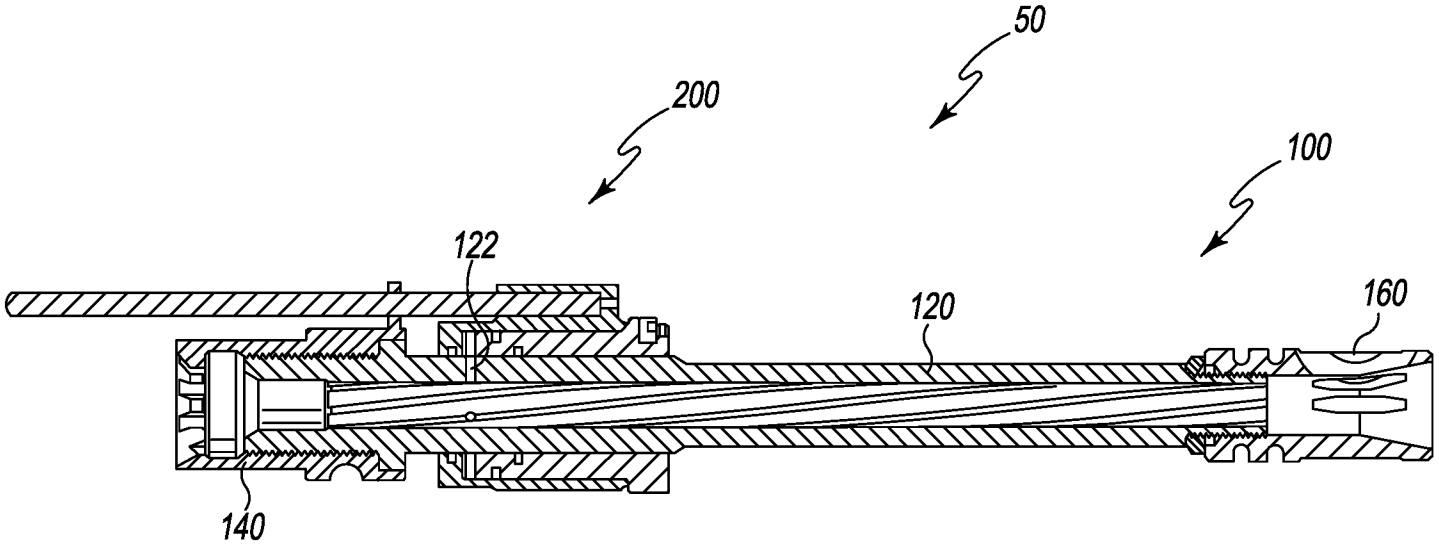
FIG. 4 is a cross sectional view of the FIG. 1 barrel assembly taken along line 4-4 in FIG. 2.
Figure 5:
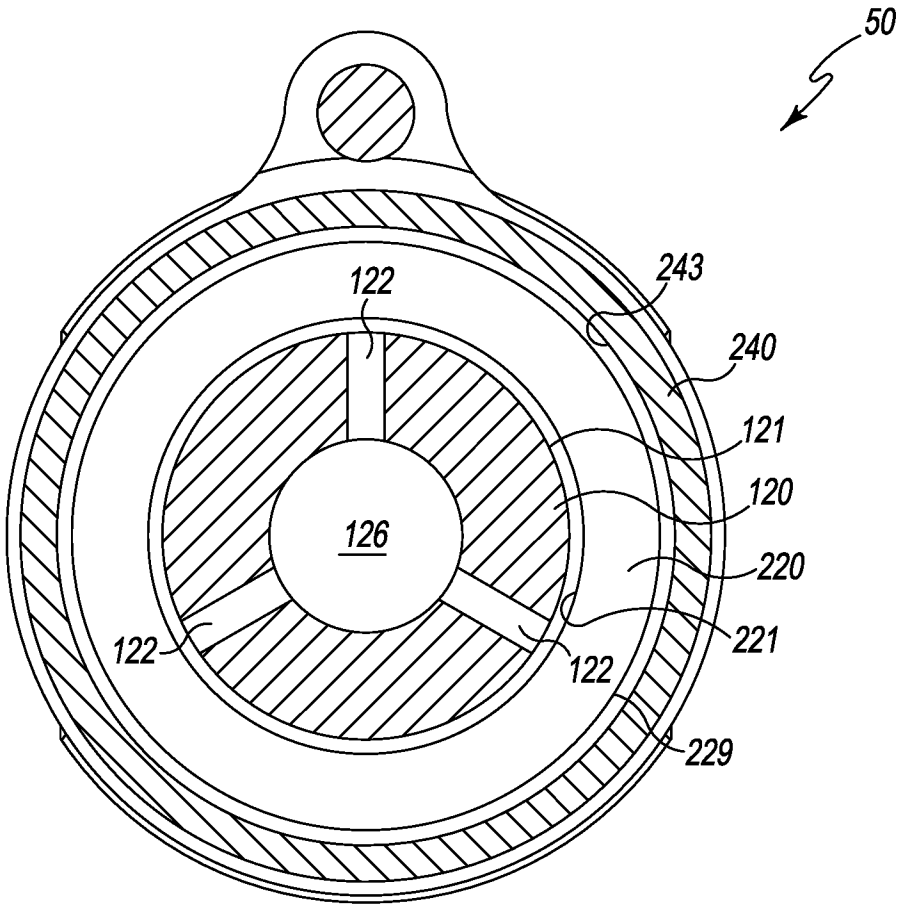
FIG. 5 is a cross sectional view of the FIG. 1 barrel assembly taken along line 5-5 in FIG. 3.
Figure 6:
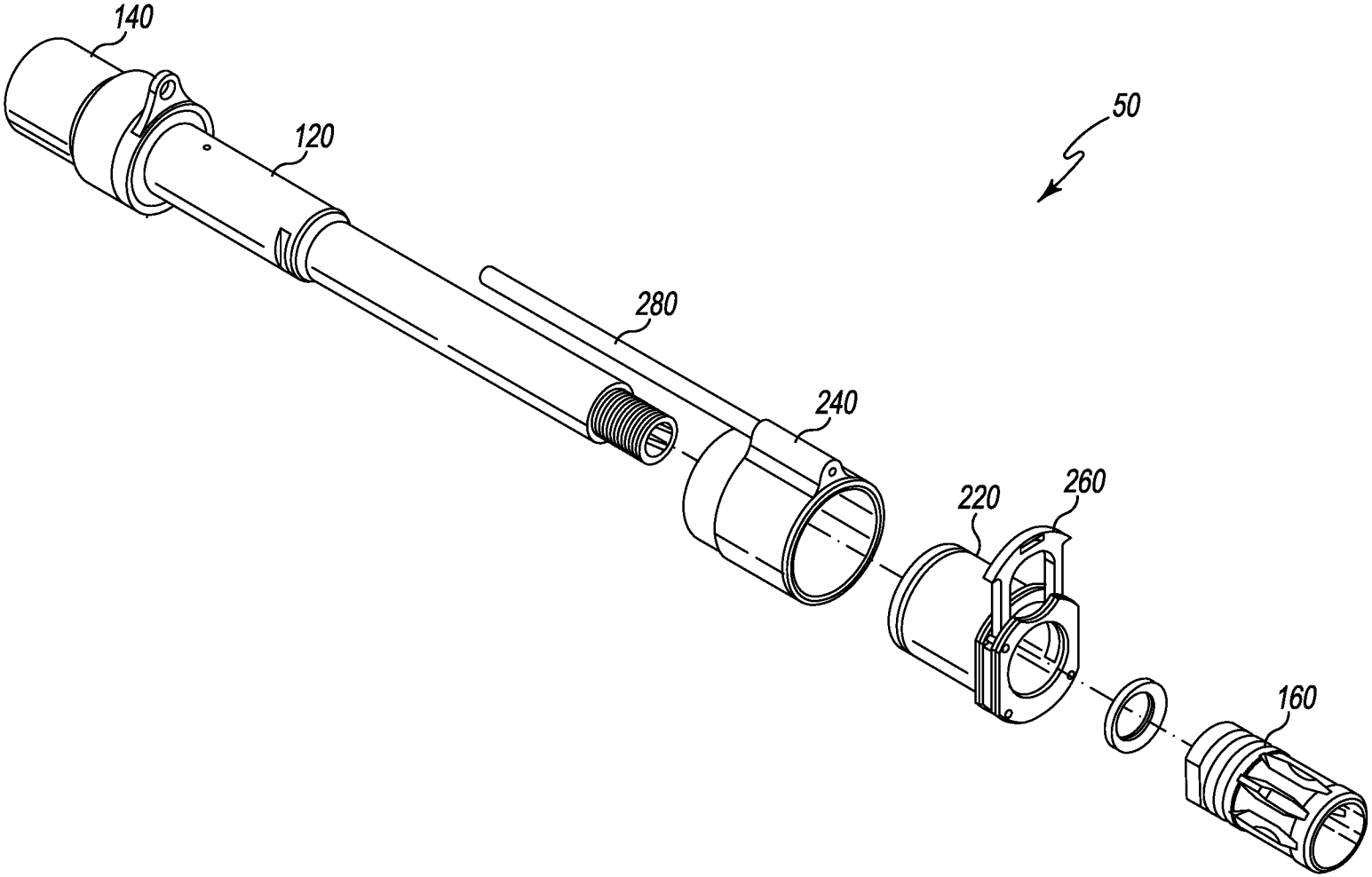
FIG. 6 is an assembly view of the FIG. 1 barrel assembly.
Figure 7:
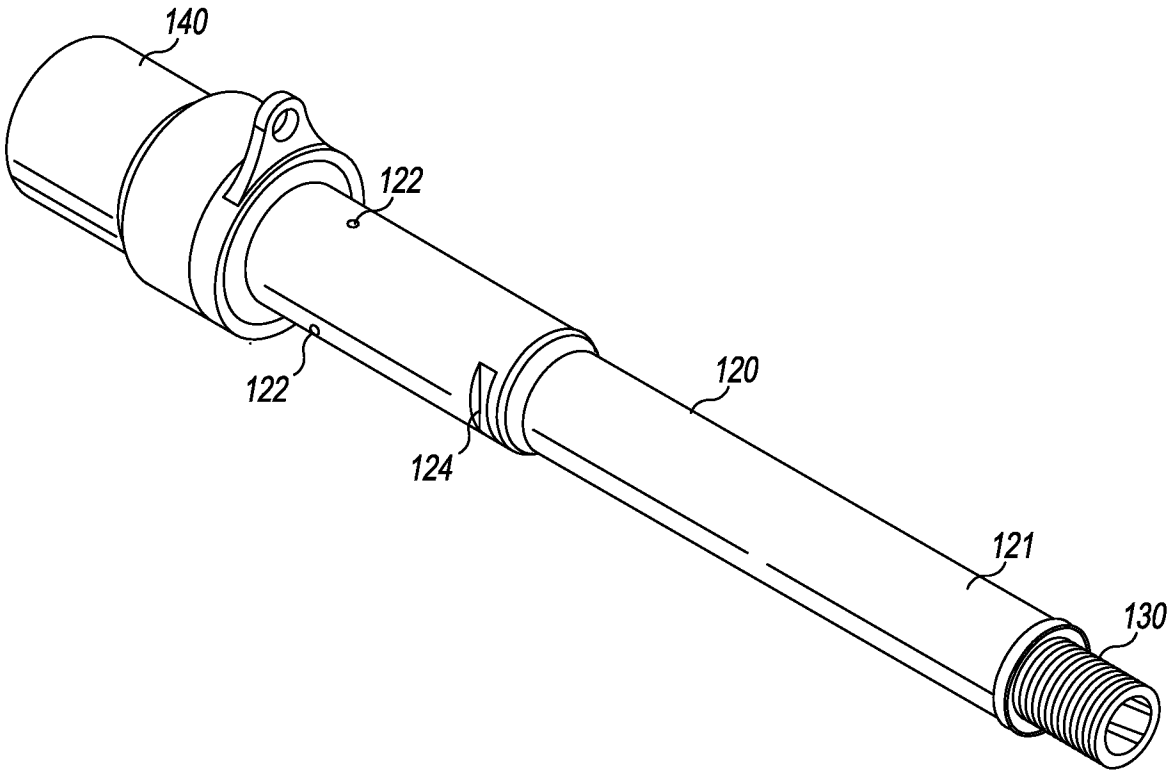
FIG. 7 is a perspective view of a barrel, a component of the FIG. 1 barrel assembly.
Figure 8:
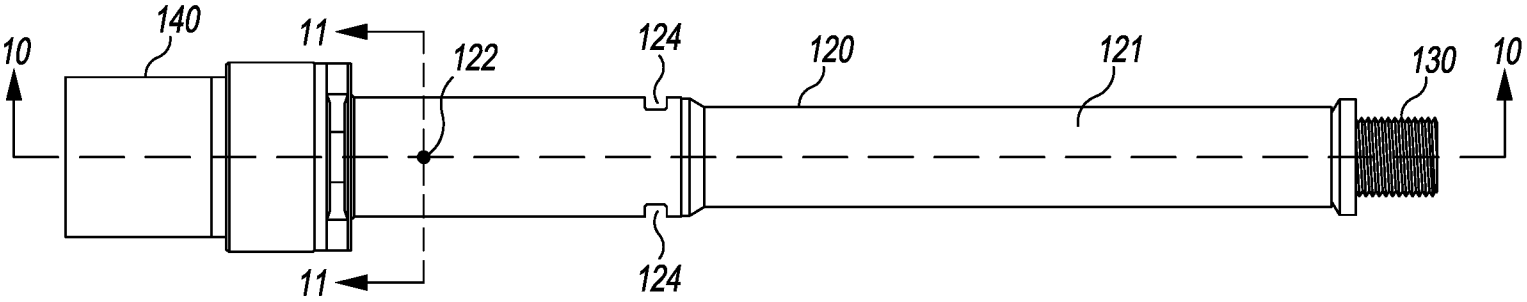
FIG. 8 is a top view of the FIG. 7 barrel.
Figure 9:
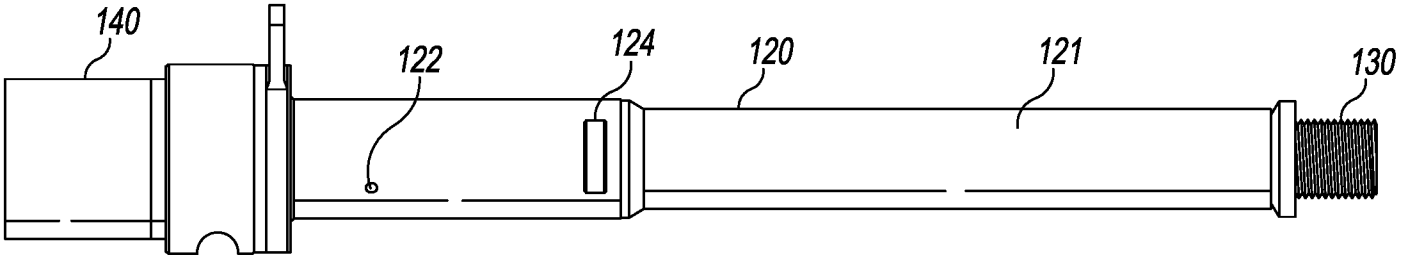
FIG. 9 is a side view of the FIG. 7 barrel.
Figure 10:
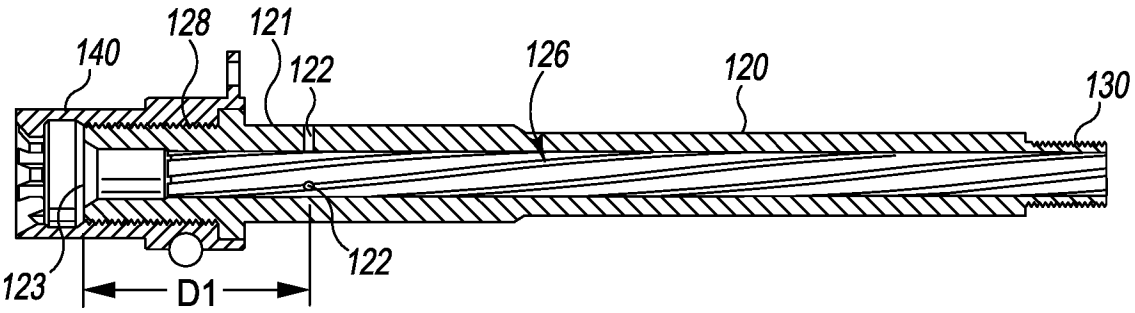
FIG. 10 is a cross sectional view of the FIG. 7 barrel taken along line 10-10 in FIG. 8.
Figure 11:
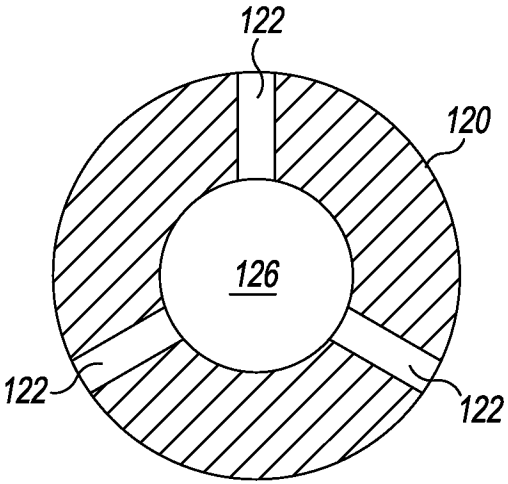
FIG. 11 is a cross sectional view of the FIG. 7 barrel taken along line 11-11 in FIG. 8.

For the purpose of promoting an understanding of the principles of the claimed invention, reference will now be made to the embodiments illustrated in the drawings and specific language will be used to describe the same. It will nevertheless be understood that no limitation of the scope of the claimed invention is thereby intended. Any alterations and further modifications in the described embodiments, and any further applications of the principles of the claimed invention as described herein are contemplated as would normally occur to one skilled in the art to which the claimed invention relates. Embodiments of the claimed invention are shown in detail, although it will be apparent to those skilled in the relevant art that some features that are not relevant to the present claimed invention may not be shown for the sake of clarity.

With respect to the specification and claims, it should be noted that the singular forms "a", "an", "the", and the like include plural referents unless expressly discussed otherwise. As an illustration, references to "a device" or "the device" include one or more of such devices and equivalents thereof. It also should be noted that directional terms, such as "left", "right", "up", "down", "top", "bottom", and the like, are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

A gas operating system for automatic cycling of a firearm using lower energy ammunition such as pistol-caliber ammunition is disclosed. The disclosed system may be configured to utilize gas produced by combustion of cartridge propellant to automatically cycle the firearm. To that end, and in accordance with some embodiments, the disclosed system includes a gas block which routes high-pressure gas from the barrel through a gas port to either a piston or to the bolt. The location of the gas port may be selected to lie within a region of the barrel which generally corresponding with declining pressure after the peak of the pressure curve associated with a given pistol cartridge. The high-pressure gas may impinge on either the piston head, forcing the piston rearward and into physical contact with an operating rod that moves to the bolt carrier, or directly against the bolt carrier of the firearm. Consequently, the bolt carrier may be driven rearward, allowing for cycling of the firearm to progress.

The disclosed gas operating system can be configured, in accordance with some embodiments, to be compatible for use with a wide range of pistol cartridges, including, but not limited to, .380 ACP, 9 mm caliber (9×19 mm); .357 caliber; .40 caliber (10×22 mm) and/or .45 ACP. The disclosed gas operating system can also be used with cartridges that have been loaded to fire subsonic projectiles, for example the 300 AAC Blackout (7.62×35 mm) and any of the above caliber cartridges loaded as subsonic ammunition. The disclosed gas operating system is configured, for example, to utilize a volume of gas for cycling a firearm that is less than that produced by a supersonic rifle cartridge, such as the 7.62×39 mm or 5.56×45 mm.

The disclosed gas operating system can be configured, for example, as: (1) a partially/completely assembled gas operating system unit; (2) a completely assembled firearm integrating such unit; and/or (3) a kit or other collection of discrete components (e.g., barrel, gas block, piston, gas regulator assembly, operating rod, etc.) which may be operatively coupled as desired to provide a firearm with automatic firing capabilities.

Referring to FIGS. 1-6, assembly 50 is illustrated. Assembly 50 generally includes barrel assembly 100 and gas block assembly 200. Barrel assembly 100 generally includes barrel 120, barrel extension 140 and flash hider 160. Gas block assembly 200 generally includes sleeve 220, sleeve 240, clip 260 and tube 280.

Referring to FIGS. 7-11, barrel 120 and barrel extension 140 are illustrated. Barrel 120 defines ports 122, breech face 123, slots 124 and bore 126. Barrel 120 also generally includes outside surface 121, and threads 128 and 130. Ports 122 extend between bore 126 and outside surface 121 of barrel 120. Ports 122 are positioned distance D1 from breech face 123. Breech face 123 is the position of the face of the bolt face (not illustrated) when firing. The illustrated embodiment includes 3 ports 122. In the illustrated embodiment, ports 122 each have a diameter of approximately 0.067" (1.7 mm). Fewer or additional ports 122 having larger or smaller sizes can be used as desired to achieve the desired venting of gasses from bore 126 as described below. For example, 2 ports 122 or 4 ports 122 or 5 ports 122.

Figure 12:
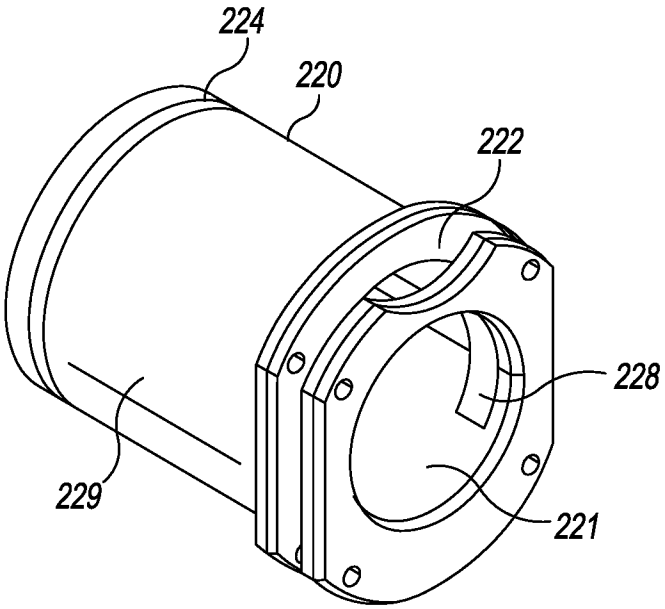
FIG. 12 is a top perspective view of a sleeve, a component of the FIG. 1 barrel assembly.
Figure 13:
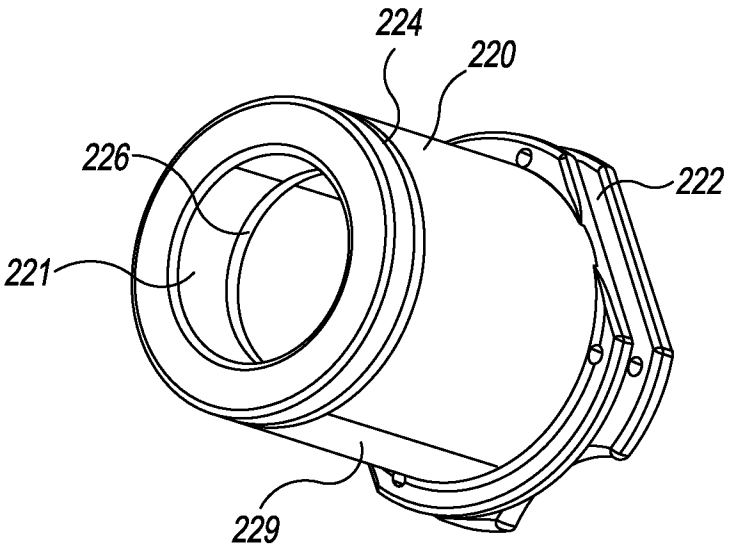
FIG. 13 is a bottom perspective view of the FIG. 12 sleeve.

Referring to FIGS. 12-13, sleeve 220 is illustrated. Sleeve 220 generally defines bore 221, groove 222, 224 and 226, slot 228 and outside surface 229. Bore 221 is configured to fit around outside surface 121 of barrel 120. Groove 222 is configured to receive clip 260 with slot 228 allowing clip 260 to engage slot 124 on barrel 120 to secure sleeve 220 in position relative to barrel 120. Groove 224 is configured to receive a sealing member such as an O-ring (not illustrated) to seal the gap between bore 243 on sleeve 220 and sleeve 140. Groove 226 is configured to receive a sealing member such as an O-ring (not illustrated) to seal the gap between bore 221 and outside surface 121 of barrel 120.

Figure 14:
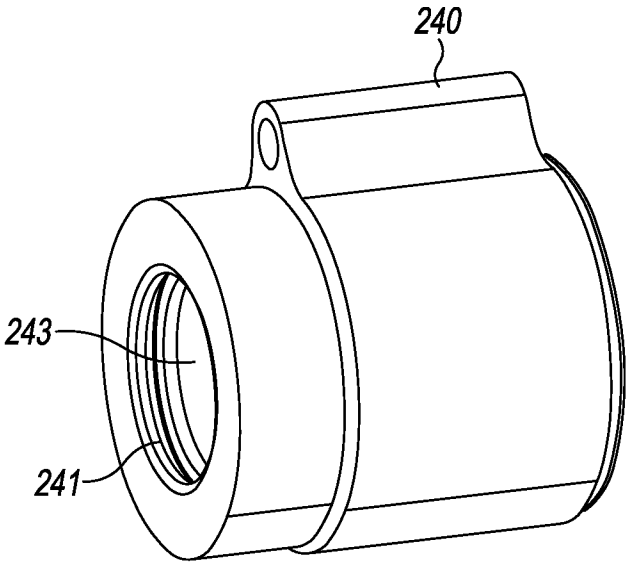
FIG. 14 is a perspective view of a sleeve, a component of the FIG. 1 barrel assembly.
Figure 15:
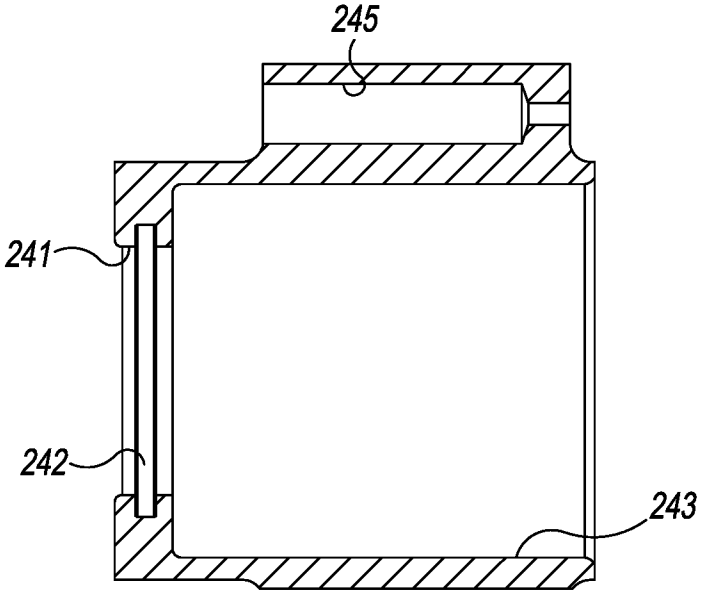
FIG. 15 is a cross sectional view of the FIG. 14 sleeve.

Referring to FIGS. 14-15, sleeve 240 is illustrated. Sleeve 240 generally defines bore 241, groove 242, bore 243 and bore 245. Bore 241 is configured to fit around outside surface 121 of barrel 120. Bore 243 is configured to fit around outside surface 229 of sleeve 242. Groove 242 is configured to receive a sealing member such as an O-ring (not illustrated) to seal the gap between bore 241 and outside surface 121 of barrel 120. Bore 245 is configured to receive tube 280. Bore 245 may also optionally be configured to receive a piston (not illustrated).

Sleeves 220 and 230 together define a gas flow passage between ports 122 and bore 245 that directs combustion gasses to tube 280 to cycle the bolt carrier using either direct gas impingement or an operating rod, as known in the art.

Figure 16:
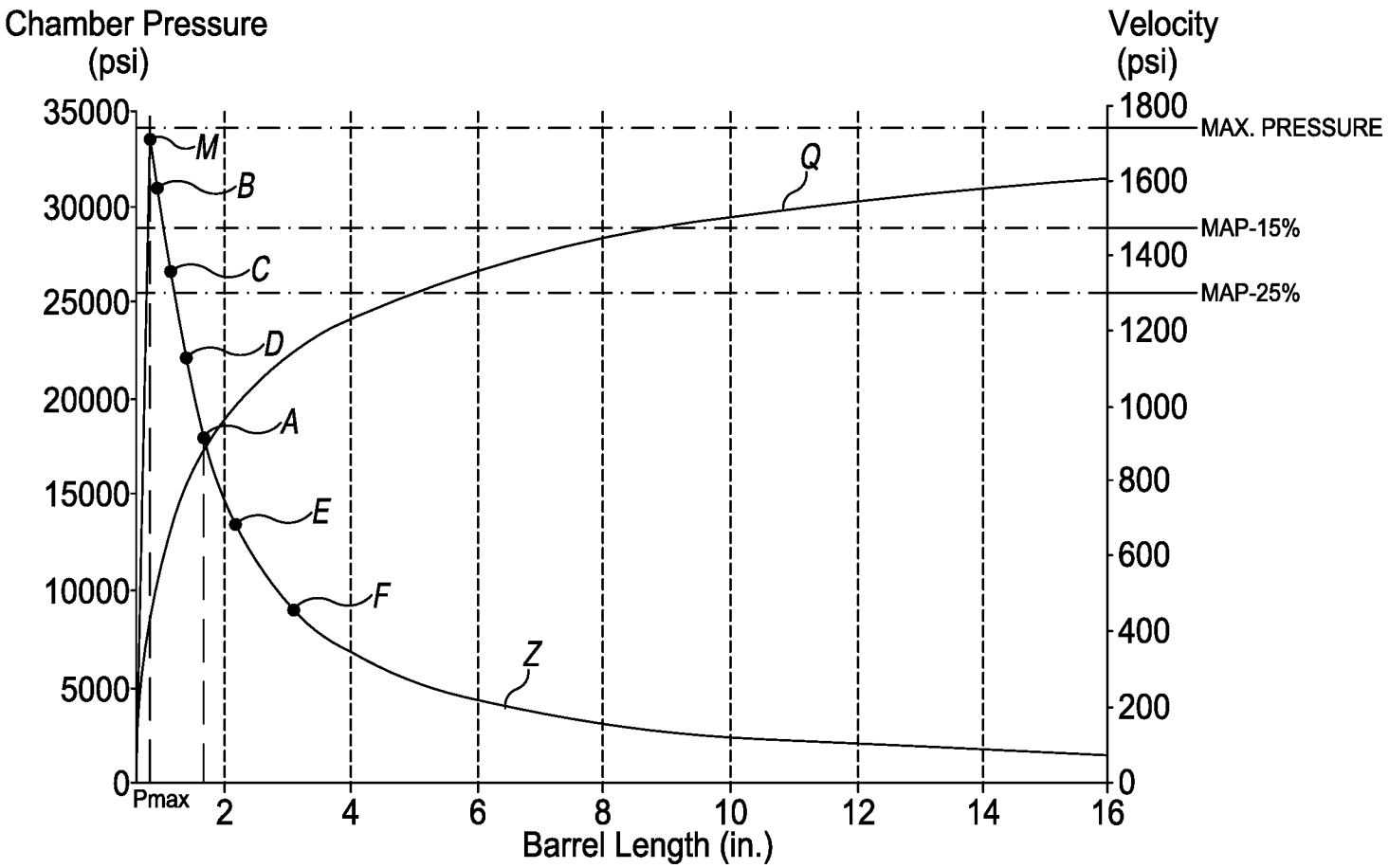
FIG. 16 is a plot of pressure vs. barrel position for a 9 mm cartridge is illustrated.
Figure 17:
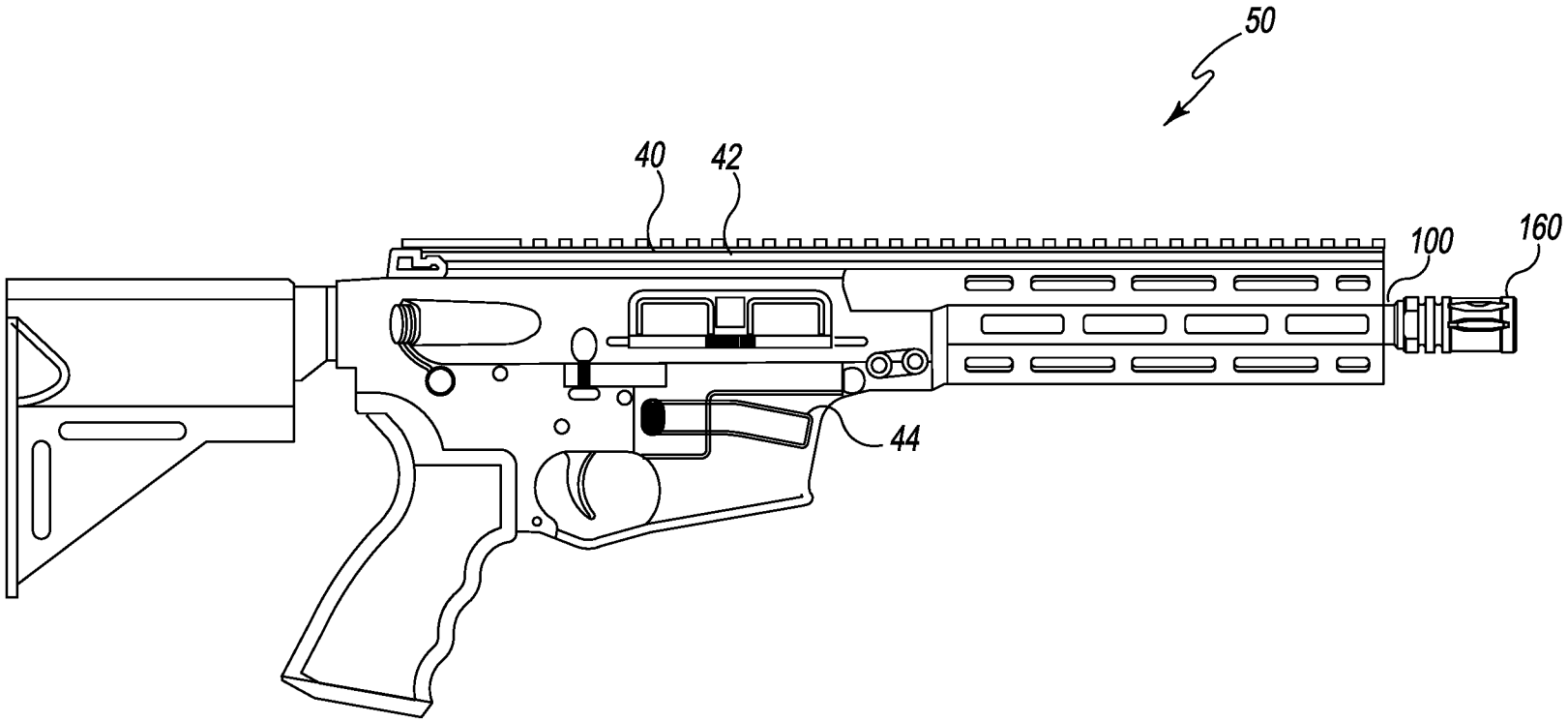
FIG. 17 is a side view of a firearm incorporating the FIG. 1 barrel assembly.

Referring to FIG. 16, a plot of pressure vs. barrel position for a 9 mm cartridge is illustrated. The x-axis is the distance in the barrel from the breech face, in inches, and is equivalent to distance D1. The y-axis is the chamber pressure in psi. Line Z is the pressure at a particular barrel position. A second y-axis indicates the velocity, in feet per second, of the projectile as it passes through the barrel. Line Q is the velocity at a particular barrel position. Maximum chamber pressure M is approximately 34,000 psi, which occurs at approximately 0.9 inches (23 mm) from the breech face.

In the illustrated embodiment, distance D1 is approximately 1.75 inches (44 mm). The position of ports 122 positioned at 1.75 inches (44 mm) is indicated as point A. At point A, the chamber pressure is approximately 18,000 psi, approximately 53% of maximum chamber pressure M. At point A, the slope of line z is approximately 70 degrees. Applicants have determined that at point A the variability between different loads is reduced while sufficient energy is still available to cycle the weapon. Applicants have found that venting too close to maximum chamber pressure M is problematic because there can be significant variance in maximum chamber pressure in different loads. Conversely, Applicants have determined that venting too far from maximum chamber pressure M can provide insufficient energy to reliable cycle the weapon. Applicants have determined that venting between approximately 90% of maximum chamber pressure M and 40% of maximum chamber pressure M provides an acceptable balance between reduced variably between loads while retaining sufficient energy to reliably cycle the weapon.

FIG. 16 illustrates various locations in this range. At point B, distance D1 is approximately 1 inch (25 mm), chamber pressure is approximately 30,600 psi, approximately 90% of maximum chamber pressure M. At point B, the slope of line z is approximately 85 degrees.

At point C, distance D1 is approximately 1.2 inches (30 mm), chamber pressure is approximately 27,200 psi, approximately 80% of maximum chamber pressure M. At point C, the slope of line z is approximately 83 degrees.

At point D, distance D1 is approximately 1.4 inches (36 mm), chamber pressure is approximately 27,200 psi, approximately 70% of maximum chamber pressure M. At point D, the slope of line z is approximately 80 degrees.

At point E, distance D1 is approximately 2.2 inches (56 mm), chamber pressure is approximately 13,600 psi, approximately 40% of maximum chamber pressure M. At point E, the slope of line z is approximately 60 degrees.

At point F, distance D1 is approximately 3.1 inches (79 mm), chamber pressure is approximately 8,500 psi, approximately 25% of maximum chamber pressure M. At point F, the slope of line z is approximately 40 degrees.

In one embodiment, distance D1 is positioned such that the chamber pressure at port 122 is between 40 and 90 percent of maximum chamber pressure M. In another embodiment, distance D1 is positioned such that the chamber pressure at port 122 is between 40 and 80 percent of maximum chamber pressure M. In yet another embodiment, distance D1 is positioned such that the chamber pressure at port 122 is between 40 and 70 percent of maximum chamber pressure M. In another embodiment, distance D1 is positioned such that the chamber pressure at port 122 is between 40 and 60 percent of maximum chamber pressure M. In yet another embodiment, distance D1 is positioned such that the chamber pressure at port 122 is between 50 and 55 percent of maximum chamber pressure M. In yet another embodiment, distance D1 is positioned such that the chamber pressure at port 122 is between 50 and 60 percent of maximum chamber pressure M. In yet another embodiment, distance D1 is positioned such that the chamber pressure at port 122 is between 50 and 70 percent of maximum chamber pressure M.

In one embodiment, distance D1 is positioned such that the slope of a plot of chamber pressure vs. distance from the breech face at port 122 is between 40 and 85 degrees. In another embodiment, distance D1 is positioned such that the slope of a plot of chamber pressure vs. distance from the breech face at port 122 is between 40 and 83 degrees. In yet another embodiment, distance D1 is positioned such that the slope of a plot of chamber pressure vs. distance from the breech face at port 122 is between 40 and 80 degrees. In another embodiment, distance D1 is positioned such that the slope of a plot of chamber pressure vs. distance from the breech face at port 122 is between 40 and 75 degrees. In yet another embodiment, distance D1 is positioned such that the slope of a plot of chamber pressure vs. distance from the breech face at port 122 is between 40 and 70 degrees. In another embodiment, distance D1 is positioned such that the slope of a plot of chamber pressure vs. distance from the breech face at port 122 is between 60 and 70 degrees.

While the present disclosure has been illustrated and described in detail in the drawings and foregoing description, the same is to be considered as illustrative and not restrictive in character, it being understood that a preferred embodiment has been shown and described and that all changes, equivalents, and modifications that come within the spirit of the claimed invention defined by following claims are desired to be protected.

The language used in the claims and the written description and in the above definitions is to only have its plain and ordinary meaning, except for terms explicitly defined above. Such plain and ordinary meaning is defined here as inclusive of all consistent dictionary definitions from the most recently published (on the filing date of this document) general purpose Merriam-Webster dictionary.

The invention claimed is:

1. A gas operating system for a firearm adapted for use with low energy ammunition, wherein the firearm includes a bolt carrier, the system comprising:

a barrel having a breech, a muzzle, a bore and a first gas port, wherein the barrel has a maximum pressure experienced at a maximum pressure location when firing the low energy ammunition and wherein the first gas port is positioned in a location that is distal from the maximum pressure location in a region of the barrel that experiences between 90% of the maximum pressure and 40% of the maximum pressure;

a gas block disposed on the barrel; and a tube operatively connecting the gas block to the bolt carrier, wherein the gas block is configured to direct energy from combustion gas pressure vented through the first gas port to the bolt carrier via the tube.

2. The gas operating system of claim 1, wherein the first gas port is positioned in a region of the barrel that experiences between 90% of the maximum pressure and 40% of the maximum pressure.

3. The gas operating system of claim 1, wherein the first gas port is positioned in a region of the barrel that experiences between 80% of the maximum pressure and 40% of the maximum pressure.

4. The gas operating system of claim 1, wherein the first gas port is positioned in a region of the barrel that experiences between 70% of the maximum pressure and 40% of the maximum pressure.

5. The gas operating system of claim 1, wherein the first gas port is positioned in a region of the barrel that experiences between 60% of the maximum pressure and 40% of the maximum pressure.

6. The gas operating system of claim 1, wherein the first gas port is positioned in a region of the barrel that experiences between 55% of the maximum pressure and 50% of the maximum pressure.

7. The gas operating system of claim 1, wherein the first gas port is positioned in a region of the barrel that experiences between 60% of the maximum pressure and 50% of the maximum pressure.

8. The gas operating system of claim 1, wherein the first gas port is positioned in a region of the barrel that experiences between 70% of the maximum pressure and 50% of the maximum pressure.

9. The gas operating system of claim 1, wherein the first gas port is positioned between 1.0 and 2.2 inches away from the breech.

10. The gas operating system of claim 1, wherein the first gas port is positioned between 1.2 and 2.2 inches away from the breech.

11. The gas operating system of claim 1, wherein the first gas port is positioned between 1.2 and 1.75 inches away from the breech.

12. The gas operating system of claim 1, wherein the first gas port is positioned between 1.4 and 1.75 inches away from the breech.

13. The gas operating system of claim 1, further comprising a piston and connecting rod that directs energy from combustion gas pressure vented through the first gas port to the bolt carrier.

14. The gas operating system of claim 1, further comprising a gas tube directs combustion gas pressure vented through the first gas port to the bolt carrier.

15. The gas operating system of claim 1, further comprising a second gas port, wherein the second gas port is positioned at the same longitudinal position as the first gas port and wherein the second gas port is radially spaced apart from the first gas port.

16. The gas operating system of claim 15, further comprising a third gas port, wherein the third gas port is positioned at the same longitudinal position as the first gas port and wherein the third gas port is radially spaced apart from both the first and second gas ports.

17. The gas operating system of claim 16, wherein the first, second and third gas ports are equally radially spaced around the barrel.

18. The gas operating system of claim 1, wherein the low energy ammunition is selected from the group consisting of: 9 mm, .40 and .45 ACP.

19. The gas operating system of claim 1, wherein the first gas port has a diameter of approximately 0.067 inches.

20. A firearm comprising:

the gas operating system of claim 1;

an upper receiver; and a lower receiver.

* * * * *